US005882244A

United States Patent [19]

Hiyama et al.

[11] Patent Number: 5,882,244

[45] Date of Patent: Mar. 16, 1999

[54] POLISHING APPARATUS

[75] Inventors: Hirokuni Hiyama, Tokyo; Yutaka Wada; Tamami Takahashi, both of Kanagawa-ken, all of Japan

[73] Assignee: Ebara Corporation, Tokyo, Japan

[21] Appl. No.: 967,767

[22] Filed: Nov. 10, 1997

Related U.S. Application Data

[63] Continuation of Ser. No. 683,427, Jul. 18, 1996, abandoned.

[30] Foreign Application Priority Data

Jul. 20, 1995 [JP] Japan ..... 7-206592

[51] Int. Cl.[6] ..... B24B 49/00

[52] U.S. Cl. ..... 451/7; 451/41; 451/285; 451/287; 451/53

[58] Field of Search ..... 451/7, 10, 11, 451/41, 285, 287, 288, 289, 53

[56] References Cited

U.S. PATENT DOCUMENTS

| | | | |
|---|---|---|---|
| 4,450,652 | 5/1984 | Walsh | 451/7 |
| 5,113,622 | 5/1992 | Nishigughi et al. | 451/7 |
| 5,127,196 | 7/1992 | Morimoto et al. | 451/7 |
| 5,196,353 | 3/1993 | Sandhu et al. | 437/228 |
| 5,245,294 | 9/1993 | Salugsugan | 451/17 |
| 5,499,733 | 3/1996 | Litvak | 216/38 |

FOREIGN PATENT DOCUMENTS 6-342778 12/1994 Japan .

*Primary Examiner*—Eileen P. Morgan
*Attorney, Agent, or Firm*—Wenderoth, Lind & Ponack, L.L.P.

[57] ABSTRACT

A polishing apparatus makes it possible to accurately detect the temperature of a workpiece during polishing and to perform polishing end point determination on the basis of this detected temperature. The polishing apparatus polishes irregularities in a surface of a workpiece such as for example a semiconductor wafer to a flat and mirror-like finish. A top ring holding a semiconductor wafer is provided with a temperature sensor. Frictional heat generated in the semiconductor wafer by polishing is detected by the temperature sensor, and a polishing end point is determined on the basis of the detected temperature.

44 Claims, 2 Drawing Sheets

POLISHING APPARATUS

This application is a continuation of now abandoned application, Ser. No. 08/683,427, filed Jul. 18, 1996.

BACKGROUND OF THE INVENTION

This invention relates to a polishing apparatus for polishing a workpiece such as a semiconductor wafer to a flat and mirror-like finish, and particularly to an end point determining method and apparatus for determining an end point of polishing.

(PRIOR ART)

In recent years, along with progress in the realization of highly integrated semiconductor devices, circuit wiring has been becoming finer and distances between wires have also been becoming smaller. In particular, in the case of photolithography of line widths on the order of submicrons, because the depth of focus is shallow, highly flat stepper focusing surfaces are required.

For this reason it is necessary to flatten the surface of the semiconductor wafer, and as one method of carrying out this flattening, polishing with a polishing apparatus has been being carried out.

Conventionally, this kind of polishing apparatus includes a turntable and a top ring each of which rotate at an independent speed. The top ring applies a fixed pressure to the turntable, a workpiece is interposed between the turntable and the top ring, and while an abrasive liquid is supplied the surface of the workpiece is polished to a flat and mirror-like finish.

A polishing cloth, which is a polishing member, is affixed to the upper surface of the turntable, abrasive liquid supplied to the upper surface of the polishing cloth is held in the polishing cloth, and the abrasive liquid is brought to act over the entire surface of the workpiece by the polishing cloth and the workpiece being moved relative to each other.

After polishing has been carried out and irregularities in the surface of the workpiece have been polished flat, it is desirable for polishing to be ended at a predetermined position.

However, there are the following difficulties in detecting this polishing end position during polishing:

(1) In the polishing apparatus described above, because the surface of the workpiece is polished with the entire surface being rubbed against another member, the surface is not exposed.

(2) During polishing, because abrasive liquid is supplied to the surface of the workpiece, the workpiece is wet.

(3) The level of finish demanded of polishing technology of recent years is of the order of Angstroms, and technology for accurately measuring quantities at this level is limited.

(4) Also, the polishing end position sought differs depending on the workpiece.

In the polishing apparatus described above, determination of the end point of polishing has generally been carried out by calculating a polishing rate of a previously polished semiconductor wafer and then using this to determine a polishing time.

Also, methods wherein frictional heat generated by polishing is detected from the surface temperature of the polishing cloth and the end point is determined on the basis of changes in this detected value have been proposed, as for example in JP-A-7-94452 (Japanese Unexamined Patent Publication No. H.7-94452). In this method, the surface temperature of the surface of the turntable of the polishing apparatus, i.e. of the polishing cloth, is detected by a non-contact temperature sensor, for example an infrared sensor, and an attempt is made to detect a polishing end point from a change in the surface temperature of the polishing cloth.

(Problems which the Invention is to Solve)

However, with a method wherein a polishing time is calculated from the polishing rate of a previously polished semiconductor wafer, because there is dispersion in the polishing rate it is difficult to carry out accurate end point determination. Furthermore, it is also necessary to consider factors such as that the polishing cloth used for polishing gradually wears with use and to correct the time of the end point accordingly.

Also, with methods wherein the temperature of the upper surface of the turntable, i.e. the surface of the polishing cloth, is detected, because the abrasive liquid fed onto the polishing cloth during polishing removes heat, it is difficult to detect an accurate temperature of the workpiece. Moreover, because the surface of the table is exposed to outside air it tends to be affected by the ambient temperature.

SUMMARY OF THE INVENTION

(Means for Solving the Prior Art Problems)

The present invention was devised to solve the problems discussed above, and an object of the invention is to provide a polishing apparatus with which it is possible to accurately detect the temperature of a workpiece during polishing and it is possible to perform polishing end point determination on the basis of this detected temperature.

To achieve the above-mentioned object and other objects, the present invention provides a polishing apparatus for polishing irregularities in a surface of a workpiece to a flat and mirror-like finish wherein a top ring for holding the workpiece is provided with a temperature sensor. Frictional heat produced in the workpiece by polishing is detected by means of the temperature sensor, and an end point of polishing is determined on the basis of such detected temperature.

The temperature sensor is disposed so as to make contact with the rear surface of the workpiece and detects the temperature of the rear surface of the workpiece.

The polishing apparatus is also provided with a signal transmitting device for sending a detection signal of the temperature sensor mounted on the top ring, which rotates, to a stationarily mounted signal processing device of the polishing apparatus.

The signal transmitting device is a wireless transmitting device mounted on the top ring.

With a polishing apparatus according to the invention, because the temperature sensor is mounted on the top ring for directly holding the workpiece, it is possible to detect an accurate surface temperature of the workpiece proportional to the polishing friction without this being affected by the abrasive liquid or the ambient temperature. Utilizing frictional heat generated by polishing for polishing end point determination is extremely effective for detecting changes in the state of the polished surface because among the physical changes occurring during polishing frictional heat shows a relatively large change. Therefore, it is possible to perform accurate end point determination on the basis of a detected temperature.

Also, because the temperature sensor is brought into contact with the rear surface of the workpiece and detects the temperature of the rear surface of the workpiece, small amounts of heat can be detected sensitively.

Furthermore, because the signal transmitting device for sending a detection signal of the temperature sensor mounted on the rotating top ring to a stationarily mounted signal processing device of the polishing apparatus is provided, transfer of detection signals between the rotating side or portion of the apparatus and the stationary side or portion of the apparatus can be carried out easily.

DETAILED DESCRIPTION OF THE PREFERRED EMBODIMENTS

Figure 1:
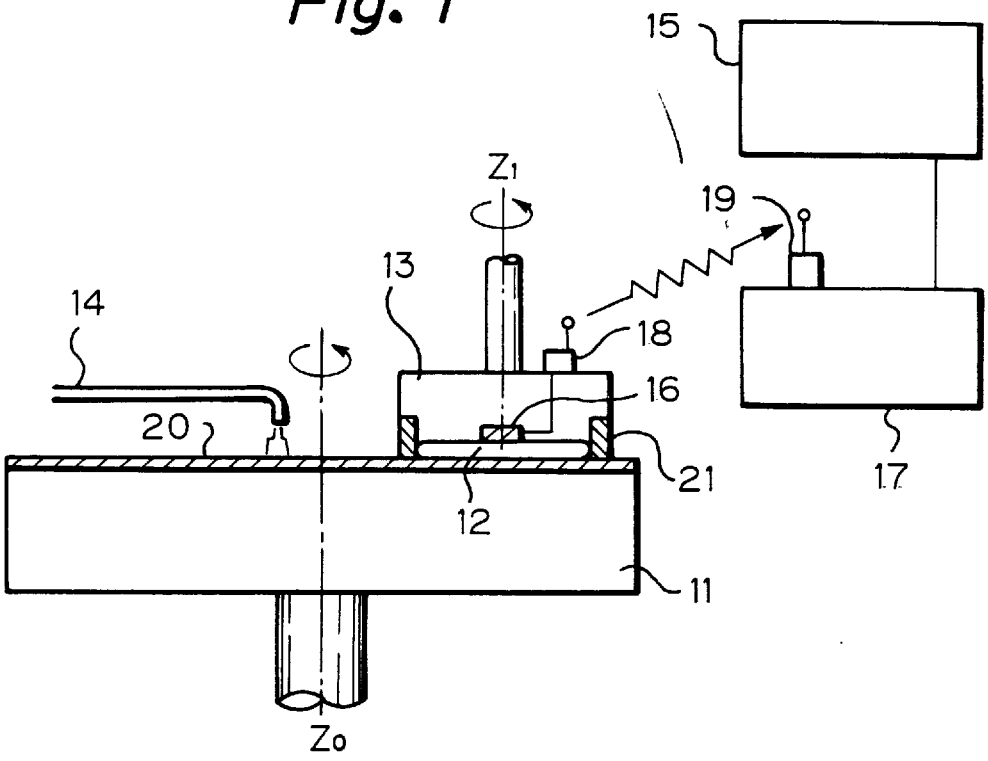
FIG. 1 is a vertical sectional view showing the overall construction of a polishing apparatus of a preferred embodiment of the invention.

A preferred embodiment of a polishing apparatus according to the invention will now be described with reference to the accompanying drawings. FIG. 1 is a vertical sectional view showing the overall construction of a polishing apparatus according to the invention.

As shown in FIG. 1, the polishing apparatus of this preferred embodiment comprises a turntable 11, a top ring 13 for holding a semiconductor wafer 12, which is a workpiece to be polished, an abrasive liquid supply nozzle 14 for supplying abrasive liquid to the surface being polished and a control device 15 for controlling the operating state of the polishing apparatus. The polishing apparatus is also provided with a temperature sensor 16 embedded in the lower end surface of the top ring, a signal processing device 17 for carrying out signal processing on a signal from the temperature sensor and telemeters 18, 19, which are wireless transmitting and receiving devices for transferring a signal from the temperature sensor to the signal processing device. Here, the signal processing device 17 is connected to control device 15 of the polishing apparatus and control of the operation of the polishing apparatus is carried out on the basis of the signal from the temperature sensor 16.

A polishing cloth 20 is affixed to the upper surface of the turntable 11, and abrasive liquid is supplied onto this polishing cloth 20 through the nozzle 14. The polishing cloth 20 is generally a cloth consisting mainly of polyurethane, and Rodel Co.'s Suba (trade name) or IC (trade name) or the like is used. The turntable is rotated about the center axis $Z_0$ by a motor not shown in the drawings.

The top ring 13 holds the semiconductor wafer 12 on its lower end surface and presses the surface of the semiconductor wafer being polished downward onto the polishing cloth. The top ring 13 is rotated by a motor not shown in the drawings about an axis $Z_1$ eccentric from the rotational center $Z_0$ of the turntable 11. The top ring also has around its periphery a guide ring 21 for preventing the wafer from flying out of from under the lower end surface of the top ring.

Polishing of the semiconductor wafer 12 is carried out by the turntable 11 and the top ring 13 being rotated and the top ring 13 being pressed down to apply a polishing pressure to the semiconductor wafer 12 while abrasive liquid is supplied through the supply nozzle 14.

These operations of the different parts of the polishing apparatus are all automatically controlled by the control device 15. For example, a rotation starting time of the turntable 11, timing of the abrasive liquid supply and stopping of polishing are all programmed into this control device and the polishing apparatus operates fully automatically.

The temperature sensor 16 embedded in the lower end surface of the top ring 13 directly detects the temperature of the rear surface of the semiconductor wafer 12 during polishing. In this preferred embodiment, a thermistor or a thermocouple is used as the temperature sensor, but other kinds of temperature sensors may alternatively be used. Because the semiconductor wafer 12 is very thin, and because it consists mainly of silicon, its thermal conductivity is good and consequently frictional heat from the wafer surface being polished is quickly transmitted to the rear surface of the wafer.

Figure 2:
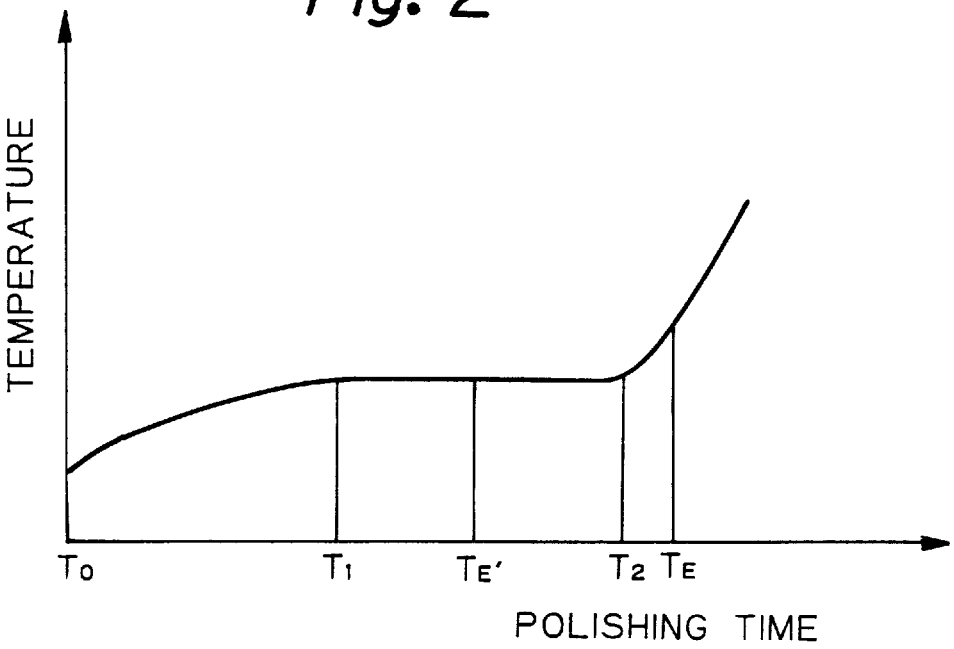
FIG. 2 is a graph showing a relationship between polishing time and temperature detected by a temperature sensor.

FIG. 2 is a graph showing an example of temperature variation of the wafer rear surface during polishing. In the graph, the horizontal axis shows polishing time and the vertical axis shows temperature detected by the temperature sensor.

When at time $T_0$ polishing is started, the temperature rises with a gentle gradient. This shows that frictional heat is generated between the semiconductor wafer and the polishing cloth and this heat raises the temperature of the semiconductor wafer and is detected by the temperature sensor 16 mounted on the lower end surface of the top ring. That is, it shows a state wherein the semiconductor wafer is accumulating heat. At time $T_1$, the amount of frictional heat generated in the semiconductor wafer and the amounts of heat removed therefrom by the abrasive liquid and by radiation to the outside air balance, and the temperature detected by the temperature sensor 16 becomes constant.

Then, at time $T_2$, the temperature rises sharply. This shows that as polishing has progressed, polishing has shifted to polishing of a material of the semiconductor wafer whose surface state is different and which generates more frictional heat.

Figure 3:
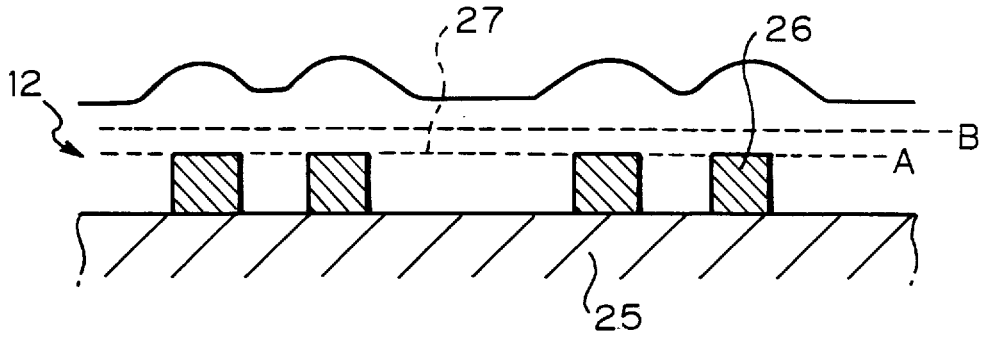
FIG. 3 is a view illustrating an example of the structure of the surface of a semiconductor wafer.

An example of an enlarged sectional view of part of the surface of a semiconductor wafer constituting a workpiece is shown in FIG. 3.

The semiconductor wafer 12 comprises metal wires 26 formed on a silicon substrate 25 and an insulating film 27 formed thereon as an upper layer.

When this kind of semiconductor wafer surface is polished, as polishing of the insulating film 27 continues, polishing moves into the region below the broken line A containing the metal wires 26. That is, the time $T_2$ shown in the graph of FIG. 2 indicates the point in time at which polishing moves into the region containing the metal wires and the amount of frictional heat starts to rise. Because a certain time after that is needed to detect this sudden temperature rise, for example if the temperature rise is detected at time $T_E$, it is determined that the time at which the broken line A was reached was time $T_2$. This determination is carried out by the signal processing device 17 shown in FIG. 1, and time $T_2$ is determined to be the end point of polishing of the region occupied by the insulating film 27 only.

The signal processing device 17 receives the signal outputted by the temperature sensor 16 from the telemeter 18 on the top ring side by way of the telemeter 19 on the signal processing device 17 side, and carries out pre-determined processing to determine the end point. When the end point is determined, the signal processing device 17 sends a polishing end point signal to the control device 15 of the polishing apparatus. The control device 15 receiving this end point signal stops polishing by stopping the rotation of the turntable 11 and the top ring 13 and stopping the supply of abrasive liquid through the abrasive liquid supply nozzle 14.

Figure 4:
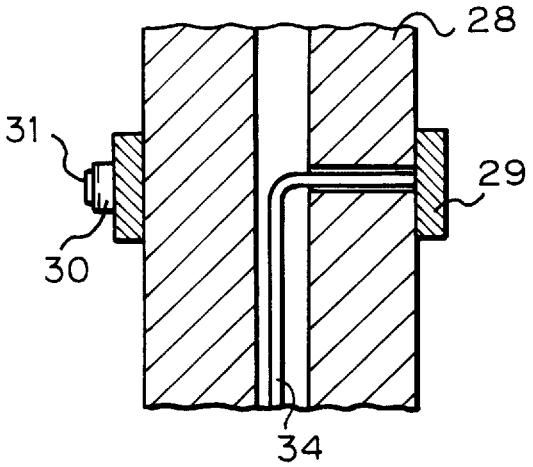
FIG. 4 is a sectional view illustrating an example of a construction for transmitting a detection signal of a temperature sensor mounted on a top ring to a signal processing device.
Figure 5:
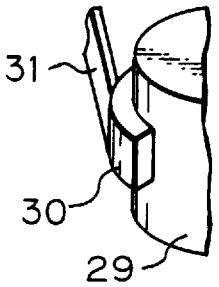
FIG. 5 is an enlarged perspective view of a main part of FIG. 4.

FIG. 4 is a view illustrating another preferred embodiment for transmitting a temperature detection signal from a rotating temperature sensor to a signal processing device, and shows the cross-sectional structure of a top ring shaft for rotationally driving a top ring. FIG. 5 is a partial perspective view of a brush contact part in FIG. 4.

The top ring shaft 28 is hollow, and a signal line 34 from a temperature sensor embedded in the top ring passes through the hollow part of the shaft and is connected to a conductor 29 consisting of for example a copper ring fitted around the outside of the top ring shaft 28. The conductor 29 is fixed to the shaft 28 and consequently rotates together therewith during polishing.

The conductor 29 makes contact with a brush 30 made of a carbon material or the like and disposed to be stationary i.e. the not rotate and the detection signal from the temperature sensor 16 is transmitted to the signal processing device 17 through the brush.

The brush 30 is stationarily connected by way of a cantilever 31, and the brush 30 is kept in contact with the conductor 29 by elasticity of the cantilever 31. As a result, transmission of the detection signal is not made unstable by for example or rotation whirling or rotation of the conductor 29.

In the preferred embodiment described above, a method for determining an end point of polishing on the basis of a temperature change occurring when polishing of the semiconductor wafer surface has progressed and shifted to polishing of a material of which frictional heat is higher was described. That is, the end point of polishing was determined at the broken line A in FIG. 3 where the upper surfaces of the metal wires 26 become exposed.

However, if the setting of the end point determination of the signal processing device 17 is changed, it is possible to make a position (broken line B) in FIG. 3 at which insulating film remains above the metal wires 26 the end point.

To do this, it is only necessary to program the signal processing device to use the time $T_1$ at which the detection signal becomes constant as a reference and determine a time a predetermined time after this to be the end point. If $T_1$ is passed and time $T_E'$ is made the end point, it is possible to end polishing at the plane of the broken line B in FIG. 3 at which insulating film remains.

Also, in FIG. 2, in detecting a change in temperature accompanying a change in the material being polished, by providing the signal processing device 17 with a differentiating circuit for differentiating the detection signal of the temperature sensor with respect to time it is possible easily to detect a change in the amount of frictional heat generated, i.e. that polishing has progressed to the broken line A in FIG. 3 at which the amount of frictional heat generated changes.

In the preferred embodiment described above, an example wherein the workpiece comprises a metal wiring film and an insulating film formed on a silicon semi-conductor wafer substrate was described. However, the workpiece is not limited to a semiconductor wafer and the substance of the invention can of course be applied to workpieces comprising different materials producing different amounts of frictional heat disposed on a glass or ceramic substrate or the like.

(Effect of the Invention)

As described above, in a polishing apparatus of the present invention a top ring for holding a workpiece is provided with a temperature sensor, and an end point of polishing is determined by detecting a change in frictional heat production accompanying the progress of polishing. Therefore, with a polishing apparatus of the invention, it is possible to determine an end point of polishing stably and certainly. As a result, it is possible to end polishing accurately at a set polishing end position such as for example a plane at which a metal wiring film becomes exposed.

What is claimed is:

1. A polishing apparatus for polishing a workpiece, said apparatus comprising:

a top ring for holding a workpiece, said top ring being operable to press a surface of the workpiece to be polished against a polishing surface, and said top ring being rotatable about an axis to extend transverse to the workpiece surface to be polished, whereby the workpiece is heated by frictional heat produced during polishing with the polishing surface;

a temperature sensor, mounted on said top ring at a position to be in contact with a surface of the workpiece opposite to the surface thereof to be polished, for sensing the temperature of the workpiece and for generating an electrical signal representative thereof; and signal processing means for determining an end point of polishing at a point in time when a certain time has passed after a time at which said signal becomes constant.

2. An apparatus as claimed in claim 1, further comprising a rotatable turntable having a surface defining the polishing surface to contact and polish the surface of the workpiece to be polished.

3. An apparatus as claimed in claim 2, wherein said turntable surface is defined by a polishing cloth mounted on said turntable.

4. An apparatus as claimed in claim 1, wherein said signal processing means is positioned on a stationary portion of said apparatus, and further comprising signal transmitting means mounted between said temperature sensor and said signal processing means.

5. An apparatus as claimed in claim 4, wherein said signal transmitting means comprises a wireless transmitter mounted on said top ring and rotatable therewith, and a wireless receiver mounted on said stationary portion of said apparatus.

6. An apparatus as claimed in claim 4, wherein said signal transmitting means comprises a slip ring mounted on a shaft for rotating said top ring, and a brush mounted on said stationary portion of said apparatus and making contact with said slip ring.

7. An apparatus as claimed in claim 1, wherein said temperature sensor comprises a thermistor or a thermocouple.

8. An apparatus as claimed in claim 1, further comprising control means operably connected to said signal processing means for controlling rotation of said top ring in response to determination by said signal processing means that said end point has been reached.

9. An apparatus as claimed in claim 1, wherein said signal processing means is operable to determine when said signal becomes constant by differentiating said signal with respect to time.

10. A method of polishing a surface of a workpiece, said method comprising:

holding said workpiece by a top ring;

pressing said surface of said workpiece against a polishing surface while rotating said top ring and said workpiece about an axis extending transverse to said workpiece surface, thereby polishing said workpiece surface by said polishing surface, during which said workpiece is heated by frictional heat produced by contact with said polishing surface;

providing a temperature sensor on said top ring at a position contacting a surface of said workpiece opposite said surface thereof being polished, and sensing a temperature of said workpiece and generating an electrical signal representative thereof; and transmitting said signal to a signal processing device and thereat determining an end point of polishing at a point in time when a certain time has passed after a time at which said signal becomes constant.

11. A method as claimed in claim 10, wherein said polishing surface is provided on a rotating turntable.

12. A method as claimed in claim 11, wherein said polishing surface is defined by a polishing cloth mounted on said turntable.

13. A method as claimed in claim 10, comprising positioning said signal processing means on a stationary portion of said apparatus, and further comprising providing signal transmitting means mounted between said temperature sensor and said signal processing means.

14. A method as claimed in claim 13, wherein said signal transmitting means comprises a wireless transmitter mounted on said top ring and rotatable therewith and transmitting said signal from said transmitter to a wireless receiver mounted on said stationary portion of said apparatus.

15. A method as claimed in claim 10, further comprising controlling rotation of said top ring in response to determination by said signal processing means that said end point has been reached.

16. A method as claimed in claim 10, comprising determining when said signal becomes constant by differentiating said signal with respect to time.

17. A polishing apparatus for polishing a workpiece, said apparatus comprising:

a top ring for holding a workpiece, said top ring being operable to press a surface of the workpiece to be polished against a polishing surface, and said top ring being rotatable about an axis to extend transverse to the workpiece surface to be polished, whereby the workpiece is heated by frictional heat produced during polishing with the polishing surface;

a temperature sensor, mounted on said top ring at a position to be in contact with a surface of the workpiece opposite to the surface thereof to be polished, for sensing the temperature of the workpiece and for generating an electrical signal representative thereof; and signal processing means for determining an end point of polishing as a function of said signal at a point in time at which said signal indicates a rise in detected temperature by differentiating said signal with respect to time.

18. An apparatus as claimed in claim 17, further comprising a rotatable turntable having a surface defining the polishing surface to contact and polish the surface of the workpiece to be polished.

19. An apparatus as claimed in claim 18, wherein said turntable surface is defined by a polishing cloth mounted on said turntable.

20. An apparatus as claimed in claim 17, wherein said signal processing means is positioned on a stationary portion of said apparatus, and further comprising signal transmitting means mounted between said temperature sensor and said signal processing means.

21. An apparatus as claimed in claim 20, wherein said signal transmitting means comprises a wireless transmitter mounted on said top ring and rotatable therewith, and a wireless receiver mounted on said stationary portion of said apparatus.

22. An apparatus as claimed in claim 20, wherein said signal transmitting means comprises a slip ring mounted on a shaft for rotating said top ring, and a brush mounted on said stationary portion of said apparatus and making contact with said slip ring.

23. An apparatus as claimed in claim 17, wherein said temperature sensor comprises a thermistor or a thermocouple.

24. An apparatus as claimed in claim 17, further comprising control means operably connected to said signal processing means for controlling rotation of said top ring in response to determination by said signal processing means that said end point has been reached.

25. A method of polishing a surface of a workpiece, said method comprising:

holding said workpiece by a top ring;

pressing said surface of said workpiece against a polishing surface while rotating said top ring and said workpiece about an axis extending transverse to said workpiece surface, thereby polishing said workpiece surface by said polishing surface, during which said workpiece is heated by frictional heat produced by contact with said polishing surface;

providing a temperature sensor on said top ring at a position contacting a surface of said workpiece opposite said surface thereof being polished, and sensing a temperature of said workpiece and generating an electrical signal representative thereof; and transmitting said signal to a signal processing device and thereat determining an end point of polishing as a function of said signal at a point in time at which said signal indicates a rise in detected temperature by differentiating said signal with respect to time.

26. A method as claimed in claim 25, wherein said polishing surface is provided on a rotating turntable.

27. A method as claimed in claim 26, wherein said polishing surface is defined by a polishing cloth mounted on said turntable.

28. A method as claimed in claim 25, comprising positioning said signal processing means on a stationary portion of said apparatus, and further comprising providing signal transmitting means mounted between said temperature sensor and said signal processing means.

29. A method as claimed in claim 28, wherein said signal transmitting means comprises a wireless transmitter mounted on said top ring and rotatable therewith and transmitting said signal from said transmitter to a wireless receiver mounted on said stationary portion of said apparatus.

30. A method as claimed in claim 25, further comprising controlling rotation of said top ring in response to determination by said signal processing means that said end point has been reached.

31. A polishing apparatus for polishing a workpiece, said apparatus comprising:

a top ring for holding a workpiece, said top ring being operable to press a surface of the workpiece to be polished against a polishing surface, and said top ring being rotatable about an axis to extend transverse to the workpiece surface to be polished, whereby the workpiece is heated by frictional heat produced during polishing with the polishing surface;

a temperature sensor, mounted on said top ring at a position to be in contact with a surface of the workpiece opposite to the surface thereof to be polished, for sensing the temperature of the workpiece and for generating an electrical signal representative thereof; and signal processing means for determining an end point of polishing as a function of said signal at a point in time at which said signal indicates a rise in detected temperature after a time at which said signal becomes constant.

32. An apparatus as claimed in claim 31, further comprising a rotatable turntable having a surface defining the polishing surface to contact and polish the surface of the workpiece to be polished.

33. An apparatus as claimed in claim 32, wherein said turntable surface is defined by a polishing cloth mounted on said turntable.

34. An apparatus as claimed in claim 31, wherein said signal processing means is positioned on a stationary portion of said apparatus, and further comprising signal transmitting means mounted between said temperature sensor and said signal processing means.

35. An apparatus as claimed in claim 34, wherein said signal transmitting means comprises a wireless transmitter mounted on said top ring and rotatable therewith, and a wireless receiver mounted on said stationary portion of said apparatus.

36. An apparatus as claimed in claim 34, wherein said signal transmitting means comprises a slip ring mounted on a shaft for rotating said top ring, and a brush mounted on said stationary portion of said apparatus and making contact with said slip ring.

37. An apparatus as claimed in claim 31, wherein said temperature sensor comprises a thermistor or a thermocouple.

38. An apparatus as claimed in claim 31, further comprising control means operably connected to said signal processing means for controlling rotation of said top ring in response to determination by said signal processing means that said end point has been reached.

39. A method of polishing a surface of a workpiece, said method comprising:

holding said workpiece by a top ring;

pressing said surface of said workpiece against a polishing surface while rotating said top ring and said workpiece about an axis extending transverse to said workpiece surface, thereby polishing said workpiece surface by said polishing surface, during which said workpiece is heated by frictional heat produced by contact with said polishing surface;

providing a temperature sensor on said top ring at a position contacting a surface of said workpiece opposite said surface thereof being polished, and sensing a temperature of said workpiece and generating an electrical signal representative thereof; and transmitting said signal to a signal processing device and thereat determining an end point of polishing as a function of said signal at a point in time at which said signal indicates a rise in detected temperature after a time a which said signal becomes constant.

40. A method as claimed in claim 39, wherein said polishing surface is provided on a rotating turntable.

41. A method as claimed in claim 40, wherein said polishing surface is defined by a polishing cloth mounted on said turntable.

42. A method as claimed in claim 39, comprising positioning said signal processing means on a stationary portion of said apparatus, and further comprising providing signal transmitting means mounted between said temperature sensor and said signal processing means.

43. A method as claimed in claim 42, wherein said signal transmitting means comprises a wireless transmitter mounted on said top ring and rotatable therewith and transmitting said signal from said transmitter to a wireless receiver mounted on said stationary portion of said apparatus.

44. A method as claimed in claim 39, further comprising controlling rotation of said top ring in response to determination by said signal processing means that said end point has been reached.

* * * * *